US009646579B1

(12) United States Patent
Nakayama et al.

(10) Patent No.: US 9,646,579 B1
(45) Date of Patent: May 9, 2017

(54) STRINGED MUSICAL INSTRUMENT

(71) Applicant: YAMAHA CORPORATION, Hamamatsu-shi (JP)

(72) Inventors: Daisuke Nakayama, Hamamatsu (JP); Hideto Matsuda, Hamamatsu (JP); Ryo Shinoda, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/294,080

(22) Filed: Oct. 14, 2016

(30) Foreign Application Priority Data

Nov. 17, 2015 (JP) ..... 2015-225208

(51) Int. Cl.
*G10D 1/08* (2006.01)

(52) U.S. Cl.
CPC ..... *G10D 1/08* (2013.01)

(58) Field of Classification Search
None
See application file for complete search history.

(56) References Cited

U.S. PATENT DOCUMENTS 651,146 A * 6/1900 Rogers ..... G10D 1/08 84/267
1,179,499 A * 4/1916 Bohman ..... G10D 1/08 84/267
2,299,923 A * 10/1942 Nall ..... G10D 1/08 84/267
2,473,980 A * 6/1949 Willner ..... G10D 1/08 84/271
4,741,238 A * 5/1988 Carriveau ..... G10D 1/085 84/291
6,025,548 A * 2/2000 Ehrlich ..... G10D 1/08 84/267
D560,708 S * 1/2008 D'Ambrosio ..... D17/20

OTHER PUBLICATIONS

"Handwork Diary, Sequel to Love for Bikes and Dislike for Celery." Wordpress.com. Retrieved from https://kazz12211. wordpress.com/%E3%82%AE%E3%82%BF%E3%83%BC%E4%BD%9C%E3%82%8A/9-felipe-conde-type-p-3/ on Sep. 4, 2015. Partial English translation provided.
"Wood & Steel." Inside the World of Taylor Guitars. Winter 2014. vol. 78, p. 15.

* cited by examiner

*Primary Examiner* — Robert W Horn
(74) *Attorney, Agent, or Firm* — Rossi, Kimms & McDowell LLP

(57) ABSTRACT

A stringed musical instrument including a body in which a cutaway is formed, wherein the body includes a back board on which at least one brace is provided so as to extend in a width direction of the back board, and wherein a first brace, which is the closest to the cutaway among the at least one brace, has a dimension in the width direction of the back board smaller than a width of the back board at a position of the back board at which the first brace is fixed, the first brace being fixed to the back board so as to be disposed nearer to one side of the back board than another side thereof on which the cutaway is formed.

7 Claims, 3 Drawing Sheets

FIG.4A
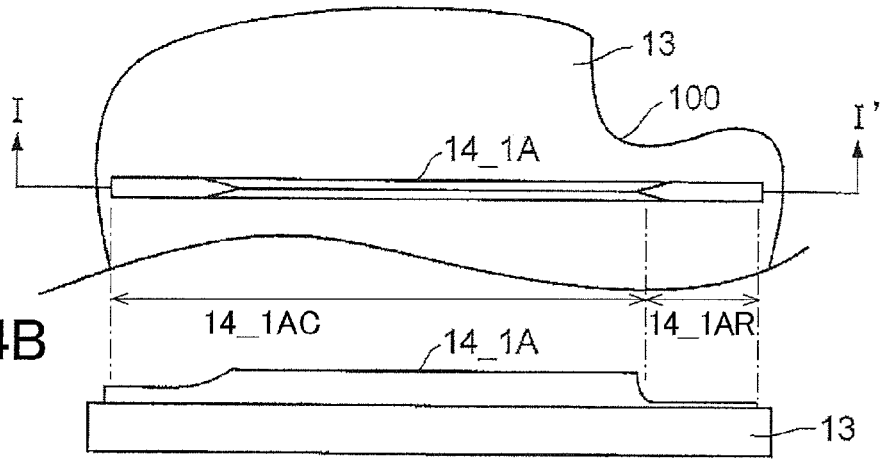
FIG.4B
FIG.5
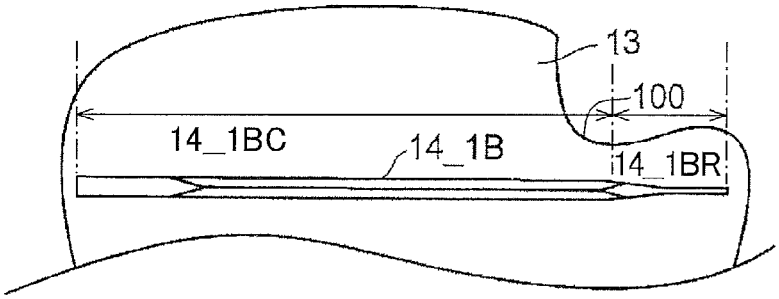
FIG.6A
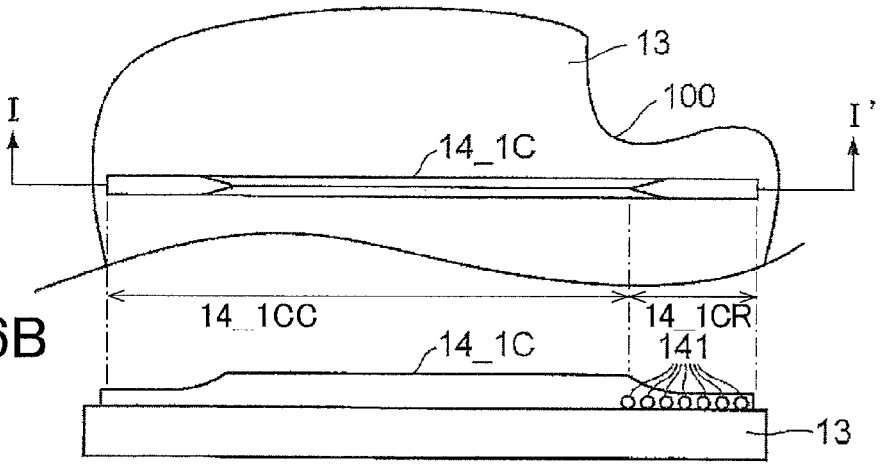
FIG.6B

STRINGED MUSICAL INSTRUMENT

CROSS REFERENCE TO RELATED APPLICATION

The present application claims priority from Japanese Patent Application No. 2015-225208, which was filed on Nov. 17, 2015, the disclosure of which is herein incorporated by reference in its entirety.

BACKGROUND

Technical Field

The present disclosure relates to a stringed musical instrument having a body in which a cutaway is formed.

Description of Related Art

In stringed musical instruments such as guitars, a cutaway is formed around a portion of a body at which the body is connected to a neck, for improving playability when playing the guitar at the high position.

Patent Literature 1: U.S. Pat. No. 4,741,238

Non-Patent Literature 1: "Handwork Diary, 'Sequel to Love for Bikes and Dislike for Celery'", Online], [retrieved on Sep. 4, 2015], Internet(URL:https://kazz12211.wordpress.com/%E3%82%AE%E3%82%BF%E3%83%BC%E4%BD%9C%E3%82%8A/9-felipe-conde-type-p-3/)

Non-Patent Literature 2: "Wood& Steel", Volume 78 Winter 2014, p. 15, Taylor guitars

SUMMARY

The cutaway formed in the body of the guitar causes a natural frequency of a back board of the body to be increased. In this case, it is sometimes difficult to obtain a tone color similar to that of a guitar without the cutaway when the guitar strings are plucked.

In view of the above, the present disclosure relates to a technique of making a tone color of a stringed musical instrument having a cutaway more similar to that of a stringed musical instrument without a cutaway.

The cutaway formed in the body of the guitar leads to a decrease in an area of the back board or the like, so that the back board or the like has an accordingly increased rigidity. In particular, the rigidity of the back board at its portion around the cutaway to which a side board is fixed becomes higher than the other portion of the back board (e.g., a central portion of the back board). A plurality of braces, generally, transverse braces, are fixed to the back board for obtaining an enough strength (rigidity). In a case where the brace is fixed to a portion of the back board near the cutaway, the rigidity of the back board is further increased at that portion. For lowering the natural frequency of the back board in the guitar having the cutaway, it is necessary to decrease a degree of influence of the brace on the rigidity of the back board.

One aspect of the present disclosure relates to a stringed musical instrument including a body in which a cutaway is formed, wherein the body includes a back board on which at least one brace is provided so as to extend in a width direction of the back board, and wherein a first brace, which is the closest to the cutaway among the at least one brace, has a dimension in the width direction of the back board smaller than a width of the back board at a position of the back board at which the first brace is fixed, the first brace being fixed to the back board so as to be disposed nearer to one side of the back board than another side thereof on which the cutaway is formed.

According to the stringed musical instrument constructed as described above, the first brace, which is fixed to the back board at the closest position to the cutaway, has a dimension in the width direction of the back board smaller than the width of the back board at a position of the back board at which the first brace is fixed. Consequently, the degree of influence of the first brace on the rigidity of a portion of the back board located near the cutaway is lowered, as compared with the degree of influence of the first brace on the rigidity of the other portion of the back board. Further, the first brace is fixed to the back board so as to be disposed nearer to one side of the back board than another side thereof on which the cutaway is formed. In this arrangement, the first brace and the cutaway is spaced apart from each other, so that the above-indicated degree of influence of the first brace is further lowered. Consequently, it is possible to reduce a rate of increase in the natural frequency of the back board of the stringed musical instrument having the cutaway with respect to the natural frequency of the back board of a stringed musical instrument not having the cutaway. It is thus possible to permit the tone color of the stringed musical instrument having the cutaway to resemble the tone color of the stringed musical instrument not having the cutaway.

The stringed musical instrument constructed as described above offers the following advantages. In a guitar not having the cutaway, the braces are conventionally fixed to the back board such that the longitudinal direction of the braces coincide with the width direction of the back board, namely, a direction perpendicular to a neck of the guitar. In contrast, in a guitar having the cutaway disclosed in Non-Patent Literature 2, the braces are fixed to the back board such that the longitudinal direction of the braces is inclined with respect to the width direction of the back board. In this case, the natural frequency of the back board to which the braces are thus fixed is smaller than the natural frequency of the back board to which the braces are fixed such that the longitudinal direction of the braces coincides with the width direction of the back board.

In an instance where the braces are fixed in the inclined form as described above, bilateral symmetry (right-left symmetry) of vibration distribution of the back board, namely, symmetry with respect to the neck of the guitar, is broken. In this instance, it is difficult to obtain the tone color similar to that of the guitar not having the cutaway. In the present disclosure, however, the braces need not be disposed in the inclined form, and the above-indicated bilateral symmetry is not broken.

Guitars disclosed in Patent Literature 1 and Non-Patent Literature 1 have a cutaway. As in the present disclosure, in each of the disclosed guitars, a brace, which is located at the closest position to the cutaway among a plurality of braces that are fixed to the back board, has a length smaller than a width of the back board at a position of the back board at which the brace is fixed. In the stringed musical instrument according to the present disclosure, however, transverse braces are fixed to the back board, namely, braces whose longitudinal direction coincides with the width direction of the back board are fixed to the back board. Thus, the present stringed musical instrument differs from the guitar disclosed in Patent Literature 1. In the stringed musical instrument according to the present disclosure, the brace, which is fixed to the back board at the closest position to the cutaway, is disposed nearer to one side of the back board than another side thereof on which the cutaway is formed. Consequently, the brace in question and the cutaway are spaced apart from each other. In this respect, the present stringed musical instrument differs from the guitar disclosed in Non-Patent Literature 1.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which:

FIGS. 4A and 4B are views of a brace a portion of which near to a cutaway has a sufficiently reduced thickness;

FIG. 5 is a view of a brace a portion of which near to the cutaway has a sufficiently reduced width; and FIGS. 6A and 6B are views of a brace a portion of which near to the cutaway has holes.

DETAILED DESCRIPTION OF THE EMBODIMENTS

Figure 1:
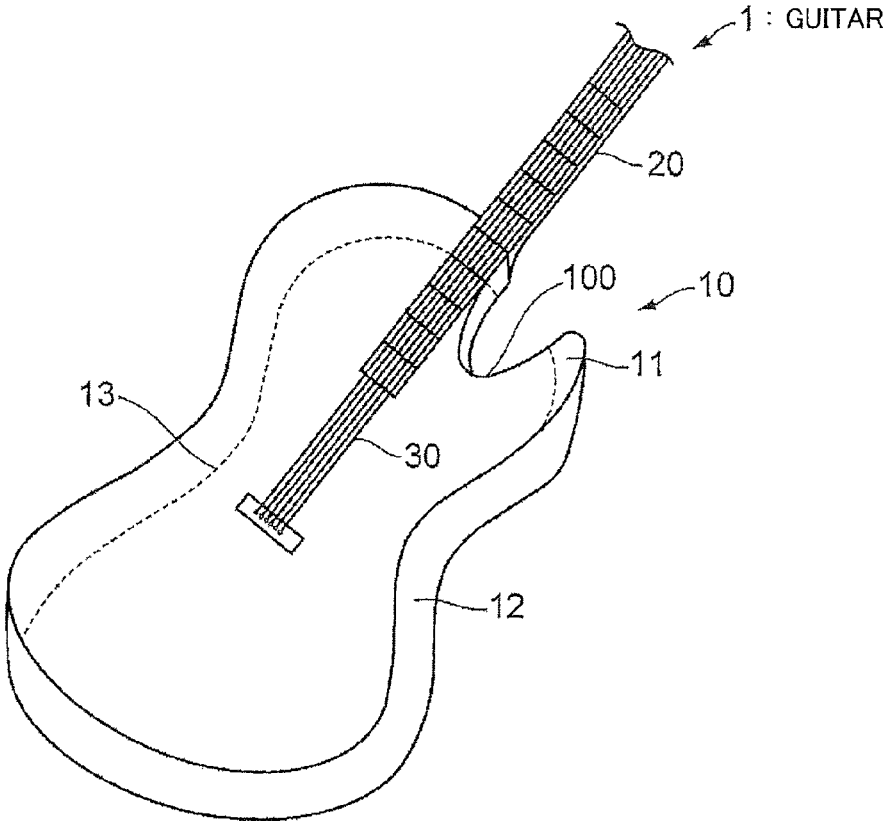
FIG. 1 is a perspective view of a guitar according to one embodiment of the present disclosure.

FIG. 1 is a perspective view of a guitar 1 according to one embodiment of the present disclosure. The guitar 1 is a guitar having a hollow body such as an acoustic guitar. As shown in FIG. 1, the guitar 1 includes the body 10, a neck 20, and strings 30. The body 10 includes a front board 11, a side board 12, and a back board 13. A cutaway 100 is formed near a portion of the body 10 at which the body 10 is connected to the neck 20. The cutaway 100 is formed for improving playability of the guitar 1 when playing the guitar 1 by pressing down the string(s) 30 at the high position. In the following explanation, a direction parallel to the neck 20 is referred to as a longitudinal direction of the back board 13, and a direction perpendicular to the neck 20 is referred to as a width direction of the back board 13.

Each of the front board 11 and the back board 13 is formed of a flat board obtained by cutting wood into a predetermined shape. The front board 11 and the back board 13 are substantially identical in shape and are opposed to each other with a space interposed therebetween. The side board 12 is a band-like board having a contour following a contour of the front board 11 and the back board 13. The side board 12 connects outer peripheries of the front board 11 and the back board 13 over entire circumferences thereof. A space defined by the boards 11-13 functions as an acoustic space in which vibration of the strings 30 is resonated.

Figure 2:
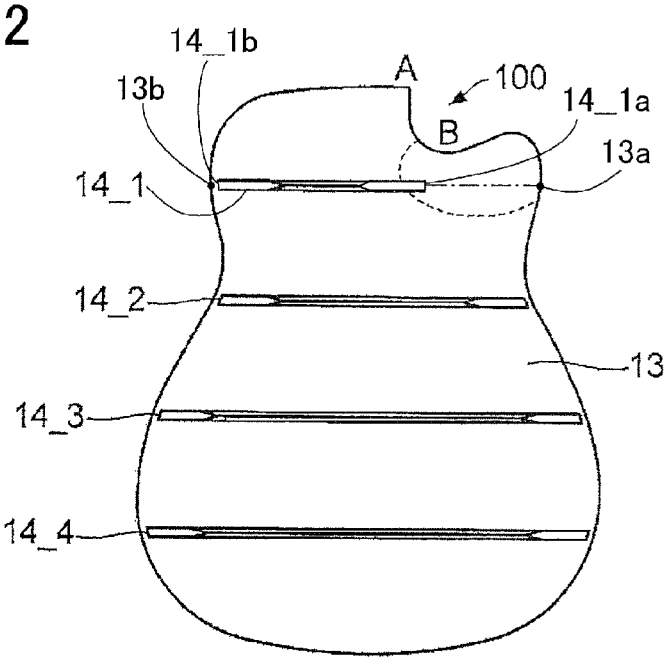
FIG. 2 is a front view showing an inner surface of a back board of the guitar according to the embodiment.

As shown in the front view of FIG. 2 showing an inner surface of the back board 13, braces 14_1 to 14_4, each of which is a bar-like member, are bonded to the inner surface of the back board 13 by an adhesive, for instance. The braces 14_1 to 14_4 are reinforcing members for ensuring strength (rigidity) of the back board 13. The braces 14_1 to 14_4 are transverse braces extending in the width direction of the back board 13. The braces 14_1 to 14_4 are fixed to the back board 13 at respective positions of the back board 13 in the longitudinal direction such that a longitudinal direction of the braces 14_1 to 14_4 coincide with the width direction of the back board 13 and such that the braces 14_1 to 14_4 are equally spaced apart from each other in the longitudinal direction of the back board 13.

As shown in FIG. 2, the brace 14_1 (as one example of a first brace) is fixed to the back board 13 such that the brace 14_1 is located at the closest position to the cutaway 100 among the braces 14_1 to 14_4. Opposite end portions of the brace 14_1 are cut away such that the thickness of the brace 14_1 perpendicular to the plane of the back board 13 is smaller at the opposite end portions of the brace 14_1 than at a central portion thereof. In an instance where the width direction of the back board 13 is defined as a right-left direction, the brace 14_1 has a shape that is symmetric in the right-left direction, i.e., a bilateral symmetric shape. The braces 14_2 to 14_4 also have a shape that is symmetric in the right-left direction.

In the present embodiment, the brace 14_1 has a length, i.e., a dimension in the width direction of the back board 13, smaller than the width of the back board 13 at a position of the back board 13 at which the brace 14_1 is fixed. (The position at which the brace is fixed will be hereinafter referred to as "brace-fixed position" where appropriate). Preferably, the length of the brace 14_1 is not smaller than 50% and not larger than 80% of the width of the back board 13 at the brace-fixed position. More preferably, the length of the brace 14_1 is not smaller than 60% and not larger than 70% of the width of the back board 13 at the brace-fixed position. As shown in FIG. 2, two edge portions on an outer periphery of the back board 13, which interest a line extending in the width direction of the back board 13 at the brace-fixed position (i.e., in a direction of extension of the brace 14_1), are respectively referred to as a first edge portion 13*a* near to the cutaway 100 and a second edge portion 13*b* remote from the cutaway 100. Further, one of opposite ends of the brace 14_1 near to the cutaway 100 is referred to as a right end 14_1*a*, and the other of the opposite ends of the brace 14_1 remote from the cutaway 100 is referred to as a left end 14_1*b*. In this case, the length of the brace 14_1, namely, a distance between the right end 14_1*a* and the left end 14_1*b* of the brace 14_1, is not smaller than 50% and not larger than 80% of a distance between the first edge portion 13*a* and the second edge portion 13*b* of the back board 13, and more preferably, not smaller than 60% and not larger than 70% of the distance between the first edge portion 13*a* and the second edge portion 13*b*. In the present embodiment, the brace 14_1 is fixed to the back board 13 so as to be disposed nearer to one side of the back board 13 than another side thereof on which the cutaway 100 is formed, namely, the brace 14_1 is fixed on the left side of a central portion of the back board 13 at which the neck 20 is connected. In this instance, the brace 14_1 is fixed to the back board 13 such that a distance between the right end 14_1*a* of the brace 14_1 and the first edge portion 13*a* of the back board 13 is larger than a distance between the left end 14_1*b* of the brace 14_1 and the second edge portion 13*b* of the back board 13. Thus, the brace 14_1 and the cutaway 100 are moderately spaced apart from each other, and the brace 14_1 and the outer periphery of the back board 13 on the one side thereof opposite to another side thereof on which the cutaway 100 is formed are moderately spaced apart from each other. For instance, the length of the brace 14_1 may be determined such that the left end 14_1*b* is located near the outer periphery of the back board 13 on the one side thereof opposite to another side thereof on which the cutaway 100 is formed (or such that the left end is located at a position that is moderately distant from the outer periphery of the back board 13 on the one side) and such that the right end 14_1*a* is located around the bottom of the cutaway 100 in the longitudinal direction of the back board 13, namely, the right end 14_1*a* is located at a position of the back board 13 that is downwardly distant from a curvature start position A at which the cutaway 100 starts to curve.

In the present embodiment, the shortest distance between: the brace 14_1: and a part of the outer periphery of the back board 13 that faces the cutaway 100, namely, a part of the outer periphery of the back board 13 that defines a curved portion of the cutaway 100, is not smaller than a predetermined distance. In the example shown in FIG. 2, the left end 14_1*b* of the brace 14_1 is fixed to the back board 13*x* near the side board 12, and the right end 14_1*a* of the brace 14_1 is fixed to the back board 13 at a position thereof that is downwardly distant, by the predetermined distance, from a position B at which the cutaway 100 is the deepest. The predetermined distance (the shortest distance) is preferably not smaller than 1 cm, and more preferably in a range from 2 to 3 cm. The position at which the right end 14_1*a* of the brace 14_1 is fixed may be determined based on the above-indicated curvature start position A of the cutaway 100.

As shown in FIG. 2, the braces 14_2 to 14_4 are fixed below the brace 14_1. Each of the braces 14_2 to 14_4 has a length, i.e., a dimension in the width direction of the back board 13, that is substantially equal to the width of the back board 13 at the corresponding position of the back board 13 at which each of the braces 14_2 to 14_4 is fixed. Each of the braces 14_2 to 14_4 has a thickness smaller at its longitudinally opposite end portions than at its central portion.

The guitar 1 of the present embodiment is thus constructed.

When the guitar strings are plucked, there is generated, in the back board 13, a natural vibration with the outer periphery of the back board 13 acting as a fixed end. In this case, the natural frequency of the back board 13 is determined based on the rigidity of the back board 13, namely, a degree of difficulty in deformation, the shape of the back board 13, and so on.

The cutaway 100 formed in the body 10 leads to a reduction in the area of the back board, and the rigidity of the back board 13 is accordingly increased. The braces fixed to the back board further increases the rigidity of the back board. Consequently, the natural frequency of the back board will increase if any suitable measure to restrain the natural frequency from increasing is not taken, and it is impossible to obtain a tone color which is similar to that of a guitar without the cutaway when the guitar strings are plucked.

In the present embodiment, the brace disposed at the closest position to the cutaway 100 is the brace 14_1 whose length is smaller than the width of the back board 13 at the position thereof at which the brace 14_1 is fixed. Thus, the degree of influence of the brace 14_1 on the rigidity of the back board 13 at its portion near the cutaway 100 is decreased.

In the present embodiment, the brace 14_1 is located at the position of the back board 13 distant, by a suitable distance, from the outer periphery of the back board 13 that faces the cutaway 100, resulting in a further decrease in the above-indicated degree of influence of the brace 14_1 on the rigidity of the back board 13 at its portion near the cutaway 100. Consequently, it is possible to reduce a rate of increase in the natural frequency of the back board 13 of the guitar 1 having the cutaway 100 with respect to the natural frequency of the back board 13 of the guitar 1 not having the cutaway 100.

In the present embodiment, the braces 14_1 to 14_4 are fixed to the back board 13 such that the longitudinal direction of the braces 14_1 to 14_4 coincides with the width direction of the back board 13. Thus, bilateral symmetry (right-left symmetry) of vibration distribution of the back board 13, i.e., symmetry with respect to the neck 20 of the guitar 1, is not broken in the present embodiment, unlike in the conventional arrangement.

According to the present embodiment, it is possible to permit the tone color of the guitar having the cutaway to resemble the tone color of a guitar not having the cutaway.

Figure 3A:
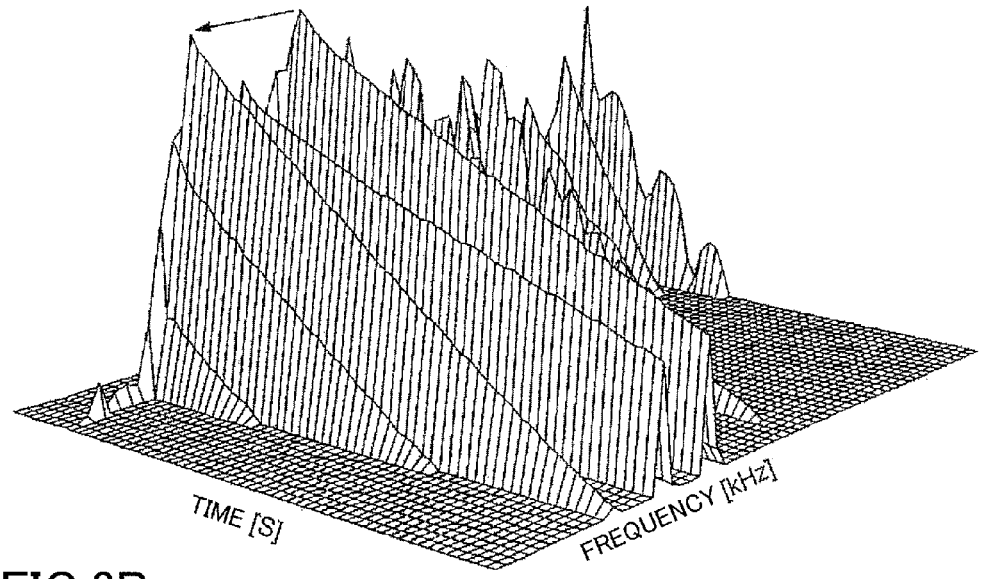
FIG. 3A is a view showing frequency characteristics of the guitar according to the embodiment and FIG. 3B is a view showing frequency characteristics of a guitar according to a comparative example.
Figure 3B:
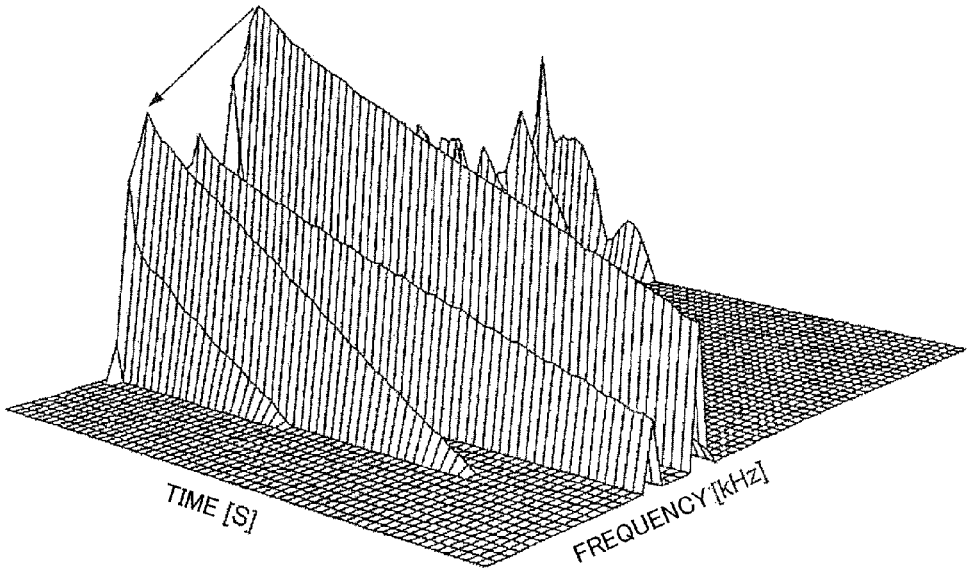

FIGS. 3A and 3B are views for explaining advantages of the present embodiment. FIG. 3A is a view showing frequency characteristics of the guitar 1 of the present embodiment, and FIG. 3B is a view showing frequency characteristics of a guitar of a comparative example. The guitar of the comparative example differs from the guitar 1 of the present embodiment only in that the brace disposed the closest to the cutaway 100 among a plurality of braces fixed to the back board 13 has a length substantially equal to the width of the back board 13 at a position of the back board 13 at which the brace is fixed. In each of FIGS. 3A and 3B, an arrow is attached to waveforms of respective frequencies of a basic mode and a secondary mode. Comparison of the two graphs reveal that a ratio of a relative sound pressure level in the basic mode with respect to a relative sound pressure level in the secondary mode is large, as shown in FIG. 3A. According to the present embodiment, the tone color in the bass range is emphasized, and the guitar having the cutaway in which the tone color in the treble range tends to be emphasized has the tone color closer to the tone color of the guitar not having the cutaway.

Modifications

The illustrated embodiment may be modified as follows, for example.

(1) In the illustrated embodiment, the disclosure relates to the guitar. The principle of the disclosure is applicable to stringed musical instruments other than the guitar. For instance, the principle of the disclosure is applicable to plucked string instruments such as ukuleles and bowed string instruments such as violins and cellos.

(2) In the illustrated embodiment, the rigidity of a portion of the brace 14_1 near to the cutaway 100 (as one example of a first portion) may be lower than the rigidity of the other portion of the brace 14_1 (as one example of a second portion which is a portion of the brace 14_1 other than the first portion, a distance between the second portion and the cutaway is larger than a distance between the first portion and the cutaway). See the following modifications (3) to (6).

(3) In the illustrated embodiment, the thickness of the brace 14_1 in a direction perpendicular to the plane of the back board 13 is smaller at its opposite end portions than at its central portion. The thickness of only the portion of the brace 14_1 near to the cutaway 100 may be made smaller than the other portion of the brace 14_1. FIGS. 4A and 4B show a brace 14_1A in which the thickness of a portion 14_1AR of the brace 14_1A near to the cutaway 100 is made sufficiently smaller than that of the other portion 14_1AC of the brace 14_1A. FIG. 4A is a front view showing the inner surface of the back board 13 on which the brace 14_1A is fixed. FIG. 4B is a cross-sectional view taken along the line I-I' in FIG. 4A. As shown in FIG. 4B, the thickness of the portion 14_1AR of the brace 14_1A near to the cutaway 100 is made sufficiently smaller than the thickness of the other portion 14_1AC of the brace 14_1A. In this instance, even when the length of the brace 14_1A is made substantially equal to the width of the back board 13 at a position of the back board 13 at which the brace 14_1A is fixed as shown in FIG. 4, the same advantages as in the illustrated embodiment are obtained.

(4) In the illustrated embodiment, the width of the portion of the brace 14_1 near to the cutaway 100 (i.e., a dimension in a direction perpendicular to the longitudinal direction of the brace 14_1 and parallel to the plane of the back board 13) may be made sufficiently smaller than the width of the other portion of the brace 14_1. FIG. 5 shows a brace 14_1B in which the width of a portion 14_1BR of the brace 14_1B near to the cutaway 100 is made sufficiently smaller than the width of the other portion 14_1BC of the brace 14_1B. As shown in FIG. 5, the width of the portion 14_1BR near to the cutaway 100 is made sufficiently smaller than that of the other portion 14_1BC. In this instance, even when the length of the brace 14_1B is made substantially equal to the width of the back board 13 at a position of the back board 13 at which the brace 14_1B is fixed as shown in FIG. 5, the same advantages as in the illustrated embodiment are obtained.

(5) In the illustrated embodiment, a sufficient number of sufficiently large holes may be formed in the portion of the brace 14_1 near to the cutaway 100. FIGS. 6A and 6B show a brace 14_1C in which holes are formed in a portion 14_1CR of the brace 14_1C near to the cutaway 100. FIG. 6A is a front view showing an inner surface of the back board 13 on which the brace 14_1C is fixed. FIG. 6B is a cross-sectional view taken along the line I-I' in FIG. 6A. As shown in FIG. 6B, a plurality of holes 141 are formed in the portion 14_CR of the brace 14_1C near to the cutaway 100 so as to extend through the portion 14_CR in its width direction. No holes 141 are formed in the other portion 14_1CC of the brace 14_1C. In this instance, even when the length of the brace 14_1C is made substantially equal to the width of the back board 13 at a position of the back board 13 at which the brace 14_1C is fixed as shown in FIG. 6, the same advantages as in the illustrated embodiment are obtained. Instead of forming the holes 141 in the portion 14_1CR near to the cutaway 100, there may be formed, in the portion 14_1CR near to the cutaway 100, holes extending through its thickness in the direction perpendicular to the plane of the back board 13 form the upper surface to the lower surface of the brace 14_1C.

(6) In the illustrated embodiment, the portion of the brace 14_1 near to the cutaway 100 may be formed of a member having a sufficiently lower rigidity than the other portion of the brace 14_1. In this instance, even when the length of the brace 14_1 is made substantially equal to the width of the back board 13 at a position of the back board 13 at which the brace 14_1 is fixed, the same advantages as in the illustrated embodiment are obtained.

(7) The above modifications (3) to (6) may be suitably combined.

What is claimed is:

1. A stringed musical instrument including a body in which a cutaway is formed, wherein the body includes a back board on which at least one brace is provided so as to extend in a width direction of the back board, and wherein a first brace, which is the closest to the cutaway among the at least one brace, has a dimension in the width direction of the back board smaller than a width of the back board at a position of the back board at which the first brace is fixed, the first brace being fixed to the back board so as to be disposed nearer to one side of the back board than another side thereof on which the cutaway is formed.

2. The stringed musical instrument according to claim 1, wherein two edge portions on an outer periphery of the back board in the width direction at the position of the back board at which the first brace is fixed include a first edge portion and a second edge portion that is farther from the cutaway than the first edge portion, and wherein the first brace is fixed to the back board such that a distance between the first edge portion and the first brace is larger than a distance between the second edge portion and the first brace.

3. The stringed musical instrument according to claim 1, wherein the first brace has a thickness in a direction perpendicular to the back board smaller at its opposite end portions in the width direction than at its central portion in the width direction.

4. The stringed musical instrument according to claim 1, wherein the first brace is fixed to the back board such that the shortest distance between the first brace and a part of an outer periphery of the back board, which part defines a curved portion of the cutaway, is not larger than 1 cm.

5. The stringed musical instrument according to claim 2, wherein the dimension of the first brace in the width direction of the back board is not smaller than 50% and not larger than 80% of a distance between the first edge portion and the second edge portion.

6. A stringed musical instrument including a body in which a cutaway is formed, wherein the body includes a back board on which at least one brace is provided so as to extend in a width direction of the back board, and wherein a first brace, which is the closest to the cutaway among the at least one brace, includes a first portion and a second portion that is a portion of the first brace other than the first portion, a distance between the second portion and the cutaway being larger than a distance between the first portion and the cutaway, and wherein the first portion has a rigidity lower than that of the second portion.

7. The stringed musical instrument according to claim 6, wherein at least one of: a thickness of the first portion in a direction perpendicular to the back board; and a width of the first portion in a direction perpendicular to a longitudinal direction of the first brace is smaller than the second portion.

* * * * *